United States Patent [19]

Flaig et al.

[11] 4,221,171

[45] Sep. 9, 1980

[54] DIRECTION SHIFT CONTROL FOR CONNECTED VEHICLE UNDERCARRIAGES

[75] Inventors: Heinz Flaig, Bochum; Martin Middeldorf, Waltrop; Udo Dietrich, Gevelsberg, all of Fed. Rep. of Germany

[73] Assignee: DEMAG, A.G., Duesseldorf, Fed. Rep. of Germany

[21] Appl. No.: 924,948

[22] Filed: Jul. 17, 1978

[30] Foreign Application Priority Data

Jul. 23, 1977 [DE] Fed. Rep. of Germany ..... 2733373

[51] Int. Cl.[2] ..... E01B 25/28

[52] U.S. Cl. ..... 104/130; 104/247; 105/176

[58] Field of Search ..... 104/130, 247; 105/176, 105/215 R

[56] References Cited

U.S. PATENT DOCUMENTS

| | | | |
|---|---|---|---|
| 3,098,454 | 7/1963 | Maestrelli | 104/130 |
| 3,797,401 | 3/1974 | Alimanestiano | 105/215 R |
| 3,828,691 | 8/1974 | Purath | 104/130 |
| 3,831,527 | 8/1974 | Peterson | 104/130 |
| 3,921,532 | 11/1975 | Nelson | 104/130 |
| 4,000,700 | 1/1977 | Hannover et al. | 104/130 |

FOREIGN PATENT DOCUMENTS

| | | | |
|---|---|---|---|
| 603469 | 6/1948 | United Kingdom | 104/247 |
| 1340008 | 12/1973 | United Kingdom | 104/130 |
| 1493577 | 11/1977 | United Kingdom | 104/130 |

*Primary Examiner*—John J. Love
*Assistant Examiner*—Ross Weaver
*Attorney, Agent, or Firm*—Mandeville and Schweitzer

[57] ABSTRACT

A shift control arrangement is provided for rail vehicles to bring about the simultaneous shifting of all directional guide wheels on the vehicle at the same time, including those in both the front and rear undercarriages of the vehicle. This is achieved by interconnecting the shift linkages of each undercarriage and, preferably, by placing the connection in the longitudinal axis of the vehicle.

4 Claims, 3 Drawing Figures

DIRECTION SHIFT CONTROL FOR CONNECTED VEHICLE UNDERCARRIAGES

BACKGROUND AND DESCRIPTION OF THE INVENTION

The invention relates to a rail vehicle with pivotal front and rear undercarriages, guided on both sides along guide rails by means of front and rear guide wheels, and connected directional guide wheels which follow directional guide rails arranged in branch switch connections, and with those directional guide wheels on each side of the undercarriage connected by means of shift linkages. Reference is made to U.S. Pat. Nos. 3,828,691 and 4,000,700, which are hereby incorporated by reference in their entirety.

German Pat. No. 2 427 870 disclosed a rail vehicle where each undercarriage is provided on both sides in front and rear with guide wheels and directional wheels which are not mechanically connected for purposes of shifting gears. Therefore, faulty switching may occur. Since the guide wheels in branch areas only adhere to guide rails on one side while the guide rails arranged on the other side of the rail recede, the rear undercarriage, too, must be equipped with directional wheels for proper guidance. If vehicles are very long it may be, particularly when branch lines follow at brief intervals, that a switch impulse for the directional wheels is given when the front directional wheels have already passed the branch, while the rear directional wheels follow the switch impulse. This inevitably leads to accidents.

It is therefore the object of the invention to provide a rail vehicle which has front and rear undercarriages including directional wheels, in such a manner that faulty switching between the two is avoided. This is done by connecting all directional guide wheels of each undercarriage of the vehicle in both the front and rear undercarriages with one another for the purpose of shifting. Before entering a switching area, be it in diverging or converging direction, all directional guide wheels are aligned in one of the two possible positions. A switch-over of some of the directional wheels while passing the branch is not possible since the directional rails provided there will not allow any pivoting movement.

Furthermore, the connection for shifting is positioned in the longitudinal center axis of the rail vehicle so that changes in length resulting during the passing of curves from the tilting of the undercarriages vs. the rail vehicle do not influence the shifting in any way. The connection is, preferably, made by means of a rod whose ends rest on levers. Each lever consists of a two-arm toggle lever positioned in the center longitudinal axis and pivoting around a vertical axis in said center longitudinal axis. Each toggle lever has one lever arm connected to the rod and the other lever arm being connected to the related linkage. The rod, together with the levers, makes up a secure connection between the directional wheels on the front and rear undercarriages and connected to one another via the shift linkages.

The shifting connection may also consist of a rod crossing the longitudinal center axis, its ends resting on uniformly long levers arranged in the longitudinal center axis of the undercarriages and connected to the shift linkages. This rod may also be replaced by two crossing cables. Furthermore, the shifting connection may be made by two adjacent Bowden control cables whose ends engage with two-arm levers connected to the shift linkages. Even a single Bowden control cable may make the connection, if there is no chance of buckling of the free wire end.

Two examples of the invention are shown on the drawings and explained as follows:

DETAILED DESCRIPTION OF THE INVENTION

Figure 1:
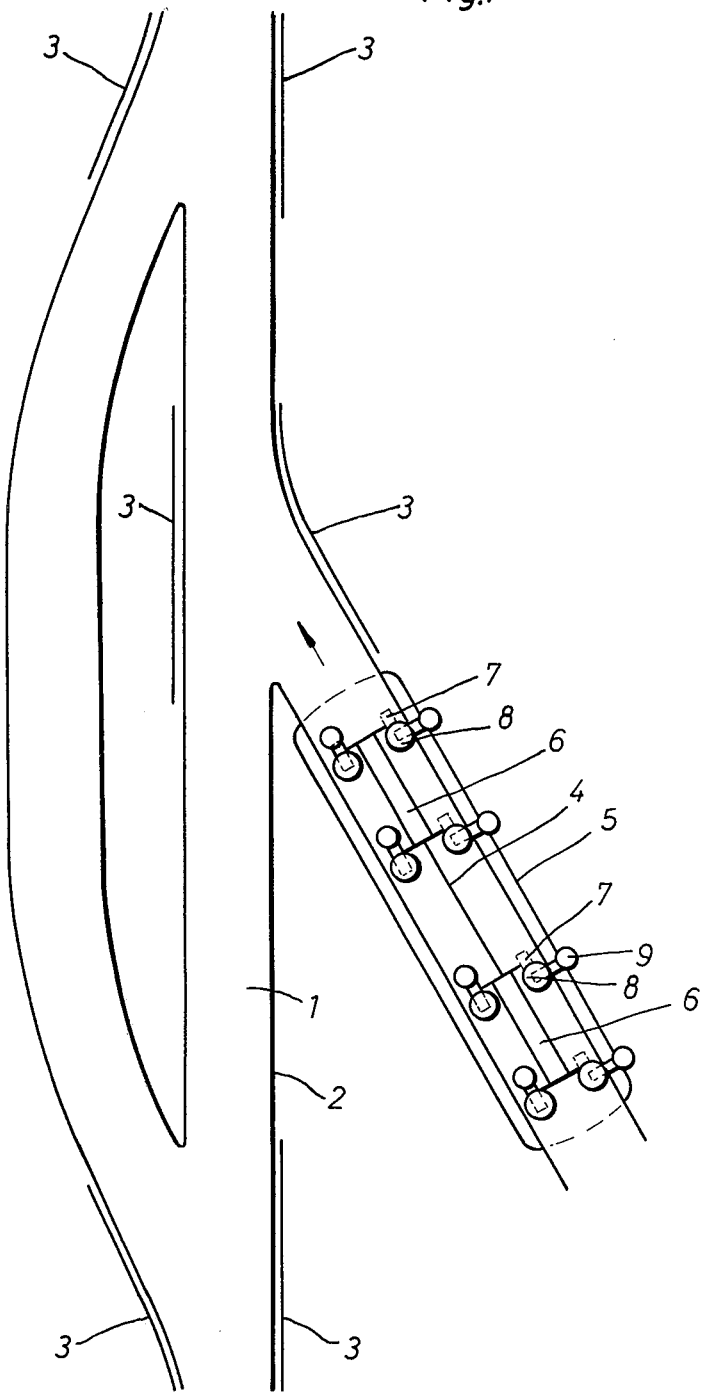
FIG. 1 is a simplified somewhat diagrammatic top plan view of a portion of a railway and showing a railway vehicle embodying the invention.

In FIG. 1 a plan view is shown as part of a rail installation with one branch line, and a vehicle entering the latter. The rail installation shows a siding opposite this branch line for a station. The rail installation is provided with rail tracks 1 with laterally arranged guide rails 2 and furthermore, in branch areas, directional rails 3.

FIG. 1 also shows rail vehicle 5 with front and rear undercarriages 6 connected via drawbar 4, and running on rails 1 with wheels 7. Each undercarriage 6 is equipped with front and rear guide wheels 8, revolving around vertical axes, to guide the undercarriages along guide rails 2 which are interrupted on one vehicle side in branch areas. Each side of the undercarriage is provided with directional guide wheels 9.

Figure 2:
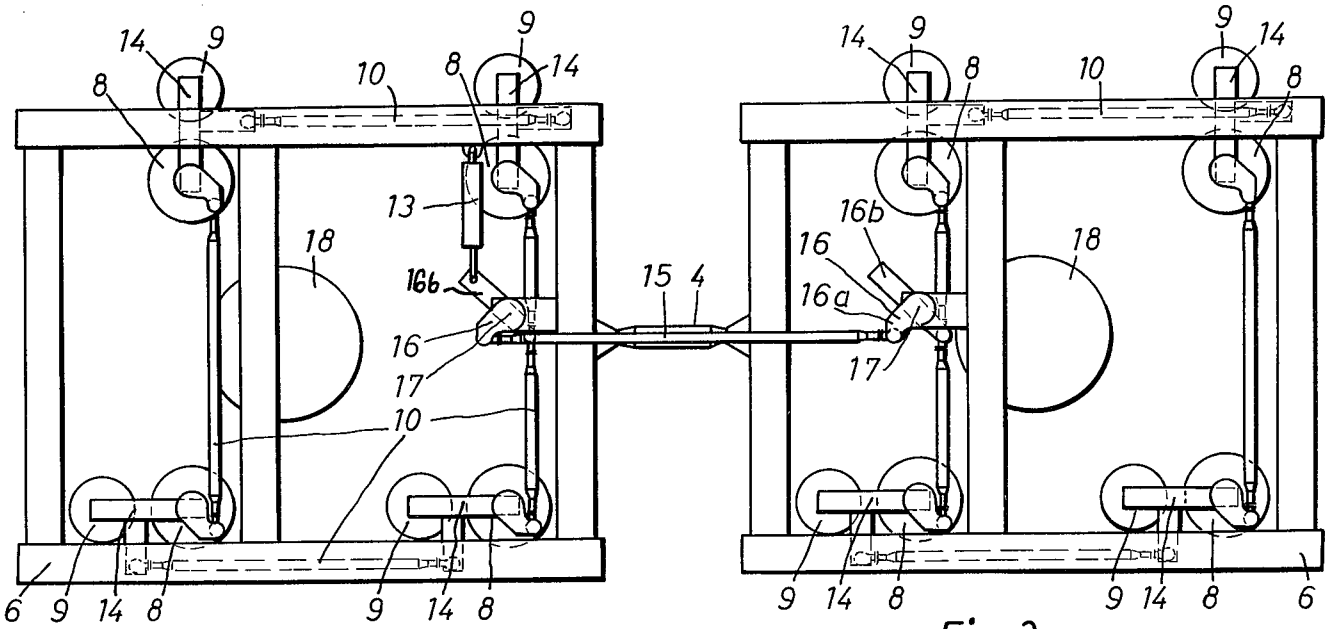
FIG. 2 is a schematic top plan view of a railway vehicle undercarriage construction showing one embodiment of the invention.
Figure 3:
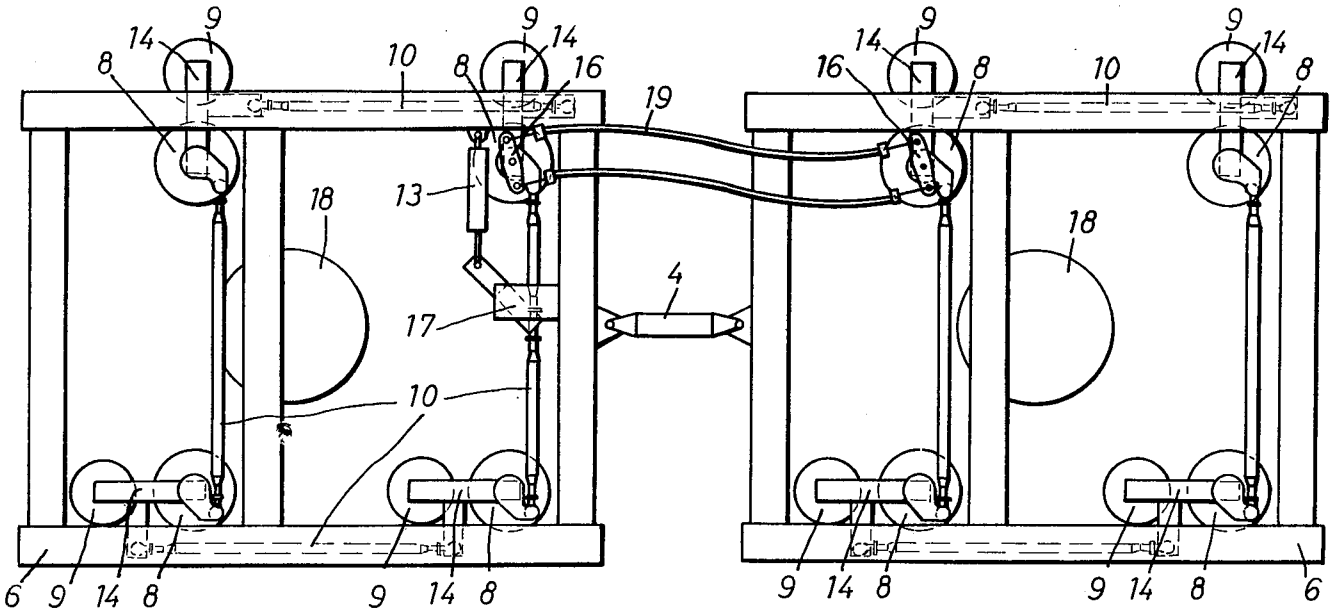
FIG. 3 is an additional schematic top plan view of a railway vehicle undercarriage showing a further embodiment of the invention.

FIGS. 2 and 3 show schematic plan views of rail vehicles supported on undercarriages 6 via elastic bearings 18, acting as turntables. Directional guide wheels 9 connected to one another via shift linkage 10 pivot around the axes of the previously mentioned guide wheels 8. The individual parts of each linkage 10 are connected to each other via switch levers, and also are connected to directional guide wheels 9. When selecting a direction, directional wheels 9 are pivoted to the desired position by motor 13 via shift linkages 10, in accordance with the direction chosen.

In the example shown in FIG. 2, the two linkages 10 of undercarriages 6 are connected for shifting by means of a rod 15 with levers **16*a*, 16*b* at each end and arranged in the center longitudinal axis. Levers 16*a,b* consists of two-arm toggle levers, and pivot around vertical axes 17 positioned in the longitudinal axis. One lever arm 16*a* is flexibly joined to rod 15, while the other lever arm 16*b* is flexibly joined to linkage 10**.

In the example shown in FIG. 3, the levers 16 also consist of two-arm levers. They are positioned on the axis of one guide wheel 8 in each undercarriage and are non-rotatably connected to the related shift levers 14 for the related directional guide wheels 9. Each end of each lever 16 in one undercarriage is connected to one end of lever 16 in the other undercarriage by one Bowden control cable 19 each, thus transmitting the pivoting movement of directional guide wheels 9 via shift levers 14 from one undercarriage to the other.

We claim:

1. In a direction control system for a railway vehicle, comprising (a) a front undercarriage and a rear undercarriage, with each undercarriage pivotally mounted on said vehicle on spaced apart vertical axes;

(b) each said undercarriage mounting guide wheels on each side thereof adjacent each corner for rotation about vertical axes;

(c) a directional guide wheel pivoted on the axis of each of said guide wheels and mounted for rotation about a vertical axis;

(d) first lever means interconnecting each of said directional guide wheels with its respective guide wheel;

(e) linkage means interconnecting said first lever means on each said undercarriage for the simultaneous pivotal movement thereof with said directional guide wheels around the vertical axes of said guide wheels; the improvement characterized by (f) connecting means connecting said linkage means of each of said front and rear undercarriages;

(g) said connecting means including a second lever positioned on each said undercarriage and connected to said linkage means, and a rod interconnecting said second levers; and (h) said connecting means causing all said directional guide wheels of said front and rear undercarriages to pivot from one position to another simultaneously.

2. The system of claim 1, further characterized by (a) said connecting means positioned in the longitudinal center axis of said front and rear undercarriages.

3. The system of claim 1, further characterized by (a) each said second lever is a toggle lever;

(b) each said toggle lever is pivoted on a vertical axis on its respective undercarriage;

(c) one arm of each toggle lever is connected to said linkage means of its respective undercarriage; and (d) the other arm of each said toggle lever is connected to said rod.

4. The system of claim 1, further characterized by (a) the arms of each said second lever being of equal length; and (b) the arms of said second levers interconnected by two parallel Bowden control cables.

* * * * *